US011390496B2

(12) United States Patent
Ladra et al.

(10) Patent No.: US 11,390,496 B2
(45) Date of Patent: Jul. 19, 2022

(54) COLLISION-FREE GUIDANCE OF A LOAD SUSPENDED FROM A CABLE

(71) Applicant: Siemens Aktiengesellschaft, Munich (DE)

(72) Inventors: Uwe Ladra, Erlangen (DE); Alois Recktenwald, Herzogenaurach (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 17/428,217

(22) PCT Filed: Jan. 23, 2020

(86) PCT No.: PCT/EP2020/051574
§ 371 (c)(1),
(2) Date: Aug. 3, 2021

(87) PCT Pub. No.: WO2020/160918
PCT Pub. Date: Aug. 13, 2020

(65) Prior Publication Data

US 2022/0089417 A1 Mar. 24, 2022

(30) Foreign Application Priority Data

Feb. 4, 2019 (EP) ..... 19155318

(51) Int. Cl.
*B66C 15/00* (2006.01)
*B66C 15/04* (2006.01)
(Continued)

(52) U.S. Cl.
CPC ..... *B66C 15/04* (2013.01); *B66C 13/16* (2013.01); *B66C 13/46* (2013.01); *B66C 2700/084* (2013.01)

(58) Field of Classification Search
CPC ..... B66C 15/04; B66C 13/16; B66C 13/46; B66C 2700/084
See application file for complete search history.

(56) References Cited

U.S. PATENT DOCUMENTS 6,140,930 A * 10/2000 Shaw ..... B66C 13/44 212/276
9,302,890 B1 * 4/2016 Vogt ..... B66C 15/045
(Continued)

FOREIGN PATENT DOCUMENTS

CN 103030069 A 4/2013
CN 109095356 A 12/2018
(Continued)

OTHER PUBLICATIONS

PCT International Search Report and Written Opinion of International Searching Authority dated Apr. 29, 2020 corresponding to PCT International Application No. PCT/EP2020/051574 filed Jan. 23, 2020.

*Primary Examiner* — Emmanuel M Marcelo
(74) *Attorney, Agent, or Firm* — Henry M. Feiereisen LLC

(57) ABSTRACT

A control unit of the crane controls drives that move an upper load suspension point and, together therewith, a load suspended via a cable system. As the upper load suspension point is moved, an inner safety zone around the load is repeatedly dynamically determined according to state variables of the crane. The state variables include at least a position and a speed of movement of the upper load suspension point, and an effective pendulum length of the load. The control unit checks, based on further known information whether an object different from the load has entered the inner safety zone, in which case the movement of the upper load suspension point is stopped or a message to stop the movement is outputted to an operator of the crane. Other-
(Continued)

wise, the movement is maintained or no message to stop the movement is outputted to the operator.

13 Claims, 6 Drawing Sheets

(51) Int. Cl.
*B66C 13/46* (2006.01)
*B66C 13/16* (2006.01)

(56) References Cited

U.S. PATENT DOCUMENTS

2013/0013251 A1* 1/2013 Schoonmaker ..... B66C 13/46 702/152
2014/0224755 A1* 8/2014 Eriksson ..... B66C 13/06 212/273
2015/0142277 A1* 5/2015 Eriksson ..... B66C 17/00 701/50
2018/0179029 A1* 6/2018 Schoonmaker ..... B66C 23/88
2018/0339886 A1 11/2018 Hashimoto et al.
2020/0307965 A1* 10/2020 Pinel ..... B66C 13/46
2021/0171324 A1 6/2021 Zhao et al.

FOREIGN PATENT DOCUMENTS

DE 102012007940 A1 10/2013
EP 0664271 A1 * 7/1995 ..... B66C 15/045
JP 3268932 B2 * 3/2002
JP 2015518804 A * 7/2015
JP 2017206351 A 11/2017
KR 102012639 B1 8/2019
RU 2347736 C2 * 2/2009
WO WO-9745359 A1 * 12/1997 ..... B66C 15/045
WO WO 9745359 A1 12/1997
WO WO-2013041770 A1 * 3/2013 ..... B66C 13/06
WO WO 2013182675 A1 12/2013

* cited by examiner

COLLISION-FREE GUIDANCE OF A LOAD SUSPENDED FROM A CABLE

CROSS-REFERENCES TO RELATED APPLICATIONS

This application is the U.S. National Stage of International Application No. PCT/EP2020/051574, filed Jan. 23, 2020, which designated the United States and has been published as International Publication No. WO 2020/160918 A1 and which claims the priority of European Patent Application, Serial No. 19155318.9, filed Feb. 4, 2019, pursuant to 35 U.S.C. 119(a)-(d).

BACKGROUND OF THE INVENTION

The present invention is based on an operating method for a crane, in particular a container crane, which has an upper load suspension point from which a load is suspended via a cable system so that the load can swing around the upper load suspension point, wherein a control facility of the crane controls drives of the crane so that the upper load suspension point, and with it the load, are moved by the control device in accordance with the actuation.

The present invention is further based on a control program for a control facility of a crane, wherein the control program comprises machine code which can be executed by the control facility, wherein the execution of the machine code by the control facility causes the control facility to operate the crane according to such an operating method.

The present invention is further based on a control facility of a crane, wherein the control facility is programmed with such a control program so that the execution of the machine code by the control facility causes the control facility to operate the crane according to such an operating method.

The present invention is further based on a crane, in particular a container crane, wherein the crane has an upper load suspension point from which a load can be suspended via a cable system so that the load can swing around the upper load suspension point, wherein the crane has drives by means of which the upper load suspension point of the crane, and with it the load, can be moved, the crane has a control facility which controls drives of the crane so that the upper load suspension point, and with it the load, are moved by the control facility in accordance with the actuation.

When operating cranes, handling a load—for example, of a container—may result in collisions of the handled load with an obstacle. The manual operation of the crane is a special case here. In manual operation, the crane is operated by a crane driver or generally an operator. The operator has full responsibility for the crane and the load guided by the crane. In particular, the operator must ensure that the load does not collide with other objects (obstacles), As a rule, the operators of such cranes are well trained and can readily assess situations which could lead to a collision. However, it can happen that—without direct influence from the operator—the control facility of the crane suddenly triggers an emergency stop (safety stop), In this case, the movement of the upper load suspension point is stopped as quickly as possible. The braking of the upper load suspension point acts on the load via the cable system. In some cases, the load is thereby shifted into an undesired pendulum movement which cannot be foreseen by the operator. As a result of the pendulum movement, a collision can occur despite, and even precisely because of the emergency stop.

Similar problems may arise in the case of automated operation of the crane if an emergency stop or safety stop is suddenly triggered.

In the prior art, solutions for collision protection are known per se. However, these solutions require that the load be rigidly connected to the upper load suspension point. In the solutions of the prior art it is therefore assumed that the load cannot swing around the upper load suspension point. For situations in which swinging of the load is possible, solutions are not known in the prior art.

The object of the present invention is to reliably ensure collision protection even when the load can swing around the upper load suspension point.

SUMMARY OF THE INVENTION

According to one aspect of the invention, the object is achieved by an operating method as set forth hereinafter. Advantageous embodiments of the operating method are the subject matter of the dependent claims.

According to the invention, an operating method of the abovementioned type is configured in that the control facility dynamically determines an inner safety zone around the load repeatedly when moving the upper load suspension point as a function of state variables of the crane, the state variables comprise at least one position of the upper load suspension point, one travel speed of the upper load suspension point and one effective pendulum length of the load around the upper load suspension point, on the basis of further information known from the control facility, the control facility checks whether an object different from the load is entering the inner safety zone, and as soon as an object enters the inner safety zone, the control facility stops the movement of the upper load suspension point or outputs a message to an operator of the crane to stop the movement of the upper load suspension point, and otherwise maintains the movement of the upper load suspension point or does not output a message to the operator of the crane to stop the movement of the upper load suspension point.

It is possible for the control facility to determine only the inner safety zone. However, it is preferably provided that the control facility dynamically determines at least one outer safety zone surrounding the inner safety zone as a function of the respective state variables, on the basis of the further information, the control facility checks whether an object different from the load is entering the outer safety zone, and as soon as an object enters the outer safety zone, the control facility reduces a travel speed of the upper load suspension point or outputs a message to an operator of the crane to reduce the travel speed of the upper load suspension point, and otherwise maintains the travel speed of the upper load suspension point or does not output a message to the operator of the crane to reduce the travel speed of the upper load suspension point.

This embodiment makes it possible to undertake or request a corresponding reduction in the travel speed in advance before the risk of a collision threatens. As a result, the travel movement can be carried out as such, but only at a reduced travel speed. Thus, the travel movement is not immediately interrupted, or such an interruption requested from the operator. The extent of the reduction in travel speed is determined by the fact that, in the event that a safety stop occurs at the reduced travel speed, the upper load suspension point can be stopped without the risk of a collision of the load with an obstacle. If necessary, a plurality of outer safety zones nested one inside the other can also be determined, the travel speed—in relation to the different outer safety zones—being reduced further and further from the outside to the inside.

It is possible for the control facility to operate in an automatic operation in which the control facility independently determines which travel movement the upper load suspension point is to carry out in each case. However, the control facility preferably operates in a manual operation in which the control facility repeatedly receives travel commands from the operator for the upper load suspension point. In this case, the control facility activates the drives at least when no object different from the load object has entered the inner safety zone or the outer safety zone, in each case in accordance with the predefined travel commands.

The control facility preferably determines a braking distance of the upper load suspension point on the basis of the current travel speed of the upper load suspension point and takes into account the braking distance of the upper load suspension point and a pendulum movement of the load around the upper load suspension point when determining the inner safety zone. This procedure makes it possible to assess the inner safety zone as well as possible. Intervention in the actually desired travel movement of the upper load suspension point is thereby reduced to those cases in which it is actually necessary.

As a rule, the control facility bases the determination of the braking distance of the upper load suspension point on a previously known, constant acceleration.

Ideally, in addition to the travel speed of the upper load suspension point and the effective pendulum length, the state variables comprise variables characteristic of the actual pendulum movement. As a result, it is possible for the control facility to determine a maximum deflection of the pendulum movement for that time at which the upper load suspension point is stopped, based on the variables characteristic of the actual pendulum movement, i.e. the specific pendulum movement at the time at which the safety stop occurs, and in the context of determining the inner safety zone, the determined maximum deflection of the pendulum movement is taken into account. As a result, the inner safety zone can be determined very precisely in accordance with the actual conditions.

Alternatively, it is possible that the state variables do not comprise the variables characteristic of the actual pendulum movement. In this case, the control facility can take into account the pendulum movement by taking a value dependent on the travel speed of the upper load suspension point and the effective pendulum length from a pendulum table and taking this value into account when determining the inner safety zone. In this case, a value which in practice corresponds to the worst possible case is stored in the pendulum table. Therefore, a worst-case assessment is carried out. This enables reliable determination of the inner safety zone even if the actual pendulum movement is not known.

It is also possible that the state variables also include a wind velocity of a wind flowing around the load. In this case, when determining the inner safety zone, the control facility can also take into account a deflection of the load by the wind. As a result, the probability of collisions can be further reduced. The wind velocity can be given as an amount independent of the direction or in the form of a vector.

Preferably, the control facility determines the deflection of the load by wind by taking a value from a wind table that is dependent on the wind velocity, a mass of the load and a contact surface of the load for the wind and, based on this value, determines the deflection of the load by the wind. This procedure is particularly efficient.

According to another aspect of the invention, the object is achieved by a control program designed in such a way that the processing of the machine code by the control facility causes the control facility to operate the crane according to an operating method according to the invention.

According to another aspect of the invention, the object is achieved by a control facility programmed with a control program according to the invention so that the control facility operates the crane according to an operating method according to the invention.

According to another aspect of the invention, the object is achieved by a crane having a control facility according to the invention.

BRIEF DESCRIPTION OF THE DRAWING

The properties, features and advantages of this invention described above and the manner in which these are achieved will become dearer and more readily understandable in connection with the following description of the exemplary embodiments, which are explained in more detail in conjunction with the drawings. These show in diagrammatic view.

DETAILED DESCRIPTION OF PREFERRED EMBODIMENTS

Figure 1:
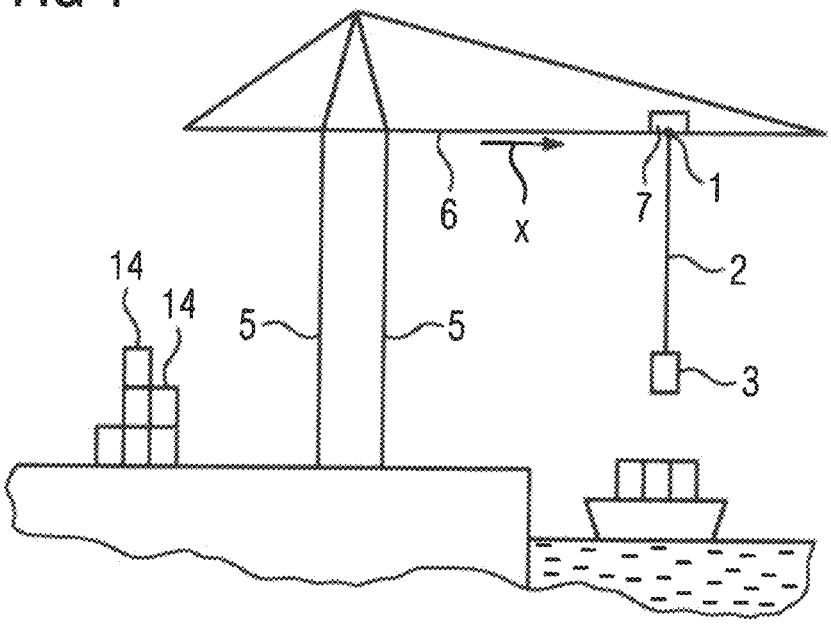
FIG. 1 A side view of a crane,
FIG. 2 The crane in FIG. 1 from above,
FIG. 3 A pendulum movement,
FIG. 4 A control diagram,
FIG. 5 A flow chart,
FIG. 6 An upper load suspension point, a load and safety zones,
FIG. 7 A first pendulum table,
FIG. 8 A second pendulum table,
FIG. 9 A flow chart,
FIG. 10 A flow chart,
FIG. 11 A flow chart,
FIG. 12 A wind table and
FIG. 13 A flow chart.
Figure 2:
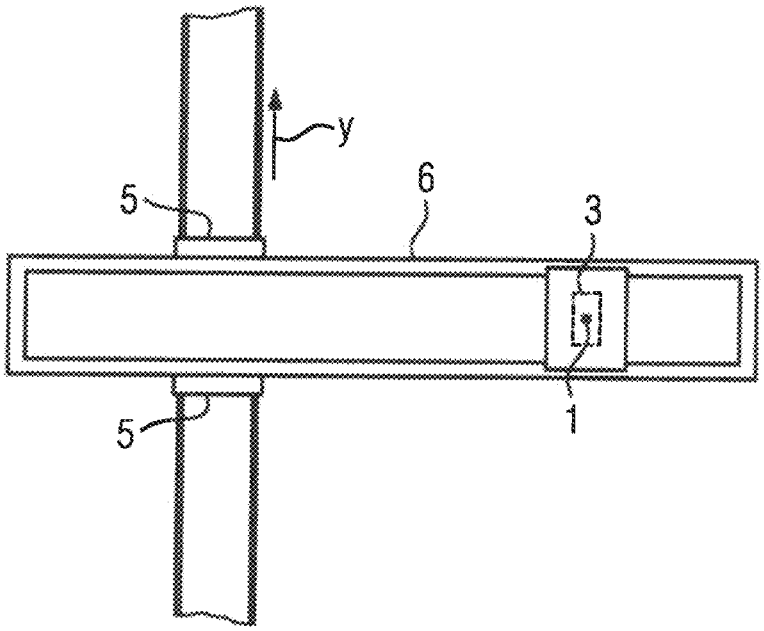
Figure 3:
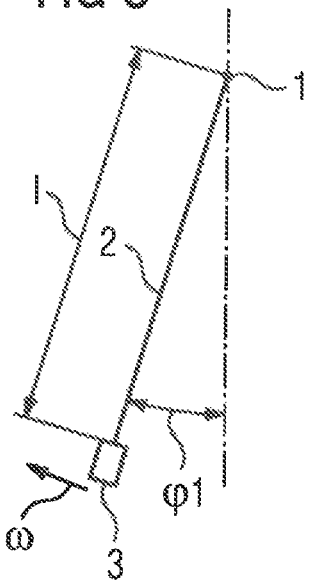

According to FIGS. 1 and 2, a crane has an upper load suspension point 1. A load 3 can be suspended from the upper load suspension point 1 via a cable system 2. Due to the fact that the load 3 is thus a hanging load, the load 3 can swing around the upper load suspension point 1, as shown in FIG. 3. The load 3 can be designed as a container, as shown in FIGS. 1 and 2, for example. In this case, the crane is a container crane.

Provided the pendulum movement takes place in a vertical plane, the pendulum movement can be fully described by three variables. These three variables are the effective pendulum length l, the current deflection angle $\varphi 1$ and the current angular velocity $\omega$. As is generally known, the current angular velocity $\omega$ corresponds to the time derivative of the current deflection angle $\varphi 1$. The current deflection angle $\varphi 1$ has a value of 0° if—within the vertical plane—the load 3 is located exactly below the upper load suspension point 1. The present invention is explained hereinafter in connection with such a pendulum movement. In the case of an additional pendulum movement in a plane orthogonal to the aforementioned vertical plane, a further current deflection angle and a further current angular velocity and, if appropriate, a phase offset of the two pendulum movements relative to one another must be taken into account. However, this is easily possible as the two planes orthogonal to one another can be considered independently of one another. The system therefore remains the same.

Figure 4:
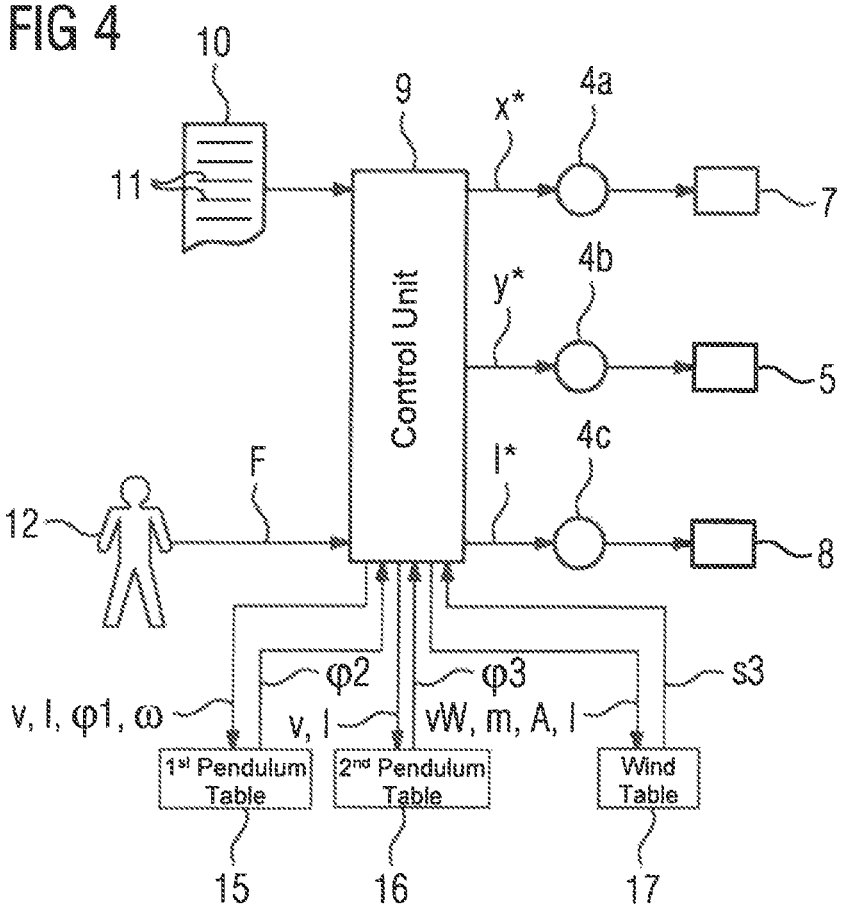

According to FIG. 4, the crane has drives 4*a*, 4*b*. The upper load suspension point 1, and with it the load 3, can be moved by means of the drives 4*a*, 4*b*. For example, as shown in FIGS. 1 and 2, the crane can have a basic framework 5 in the upper region of which a crossmember 6 extends. A trolley 7 can be arranged on the crossmember 6 and can be moved in an x direction by means of the drive 4*a* by presetting a corresponding set point x*. The upper load suspension point 1 is arranged on the trolley 7 in this case. In addition, it is possible that the basic framework 5 as a whole can be moved in a y direction by means of the drive 4*b* by specifying a corresponding set point y*. The x direction and the y direction are orthogonal to one another, and both extend (exactly or at least substantially) horizontally. The crane also has a further drive 4*c*, which drives a lifting mechanism 8. By means of the further drive 4*c* and the lifting mechanism 8, the load 3 can be raised and lowered by presetting a corresponding set point l* and adjusting the effective pendulum length l accordingly.

In the case of such an embodiment—i.e. as a crane with a basic framework 5, a crossmember 6 and a trolley 7—the crane can, for example, be designed as a gantry crane or as a container bridge. In particular, container bridges are often used for transferring containers to and from ships (STS=ship to shore). However, other embodiments are also possible, for example as gantry cranes. Also, the load 3 need not necessarily be a container, even if this is often the case.

The corresponding set points x*, y*, l* (or the specification of directions of change and if applicable also rates of change) are specified by a control facility 9 which controls the drives 4*a*, 4*b*, 4*c* of the crane. The upper load suspension point 1, and with it the load 3, are moved in accordance with the actuation of the drives 4*a*, 4*b*, and the load 3 is raised or lowered in accordance with the actuation of the drive 4*c*.

The control facility 9 is programmed with a control program 10. The control program 10 comprises machine code 11 which can be executed by the control facility 9. The execution of the machine code 11 by the control facility 9 causes the control facility 9 to operate the crane according to an operating method which is explained in more detail hereinafter.

In the context of the present invention, it is assumed that the crane executes a travel movement in the x direction. For a travel movement in the y direction or a combined travel movement both in the x direction and in the y direction, fully analogous executions apply, where applicable.

Figure 5:
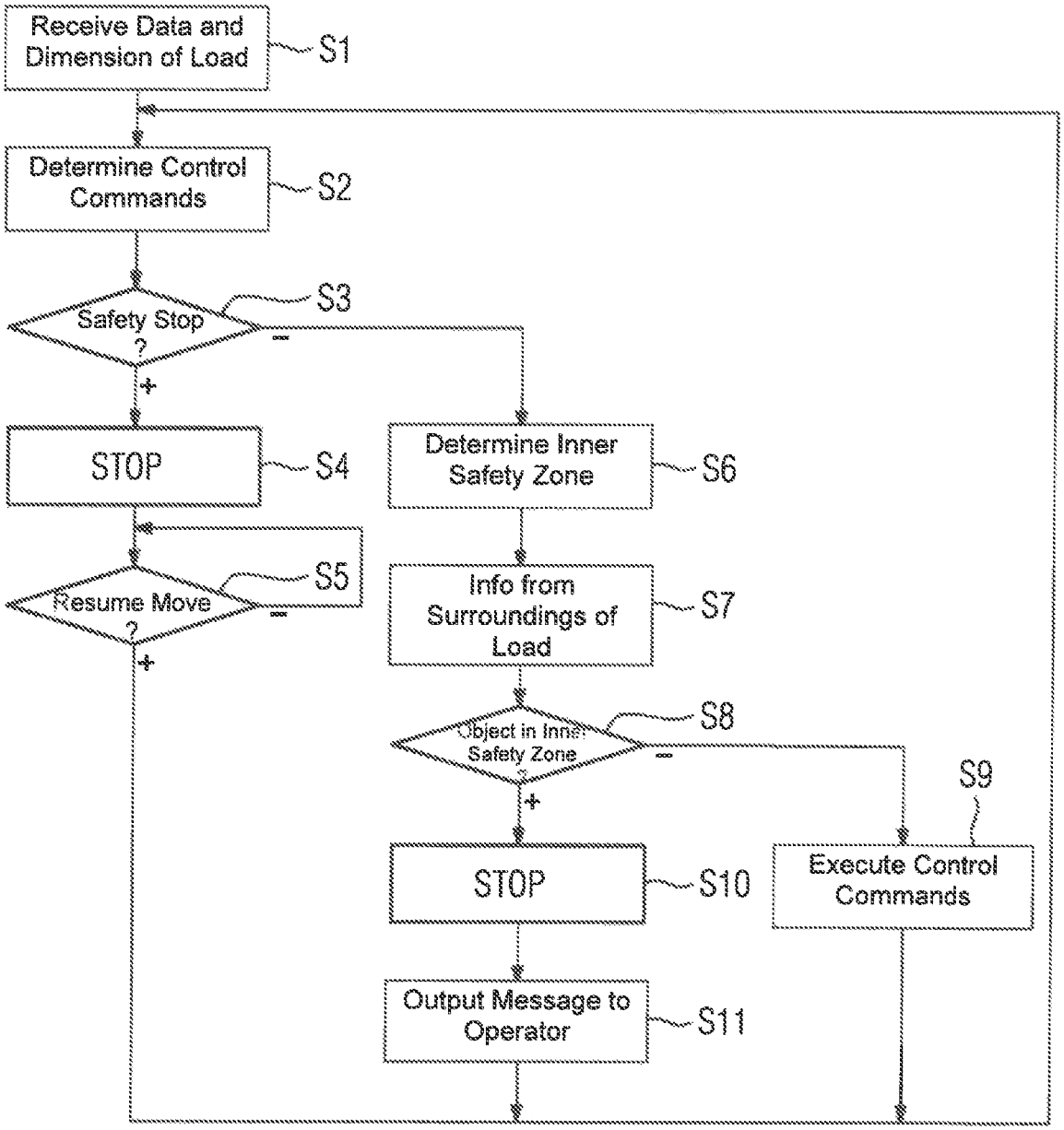

According to FIG. 5, the control facility receives data from the load 3 in a step S1. In particular, the data can comprise the mass and the dimensions of the load 3.

In a step S2, the control facility 9 determines—even if only provisionally—control commands C for the drives 4*a*, 4*b*, 4*c*. In an automatic operation, the control facility 9 determines the control commands C independently with the aid of its control program 10. In a manual operation, the control facility 9 determines the control commands C on the basis of travel commands F from an operator 12. The control commands C determine in particular the set points x*, y* and l* for the drives 4*a*, 4*b*, 4*c*.

The manner in which the control commands C are determined is of subordinate importance in the context of the present invention. Preferably, however, the control facility 9 operates in manual operation, in which the control facility 9 repeatedly receives the travel commands F from the operator 12. In this case, the travel commands F comprise, on the one hand, the travel commands for moving the upper load suspension point 1. On the other hand, they comprise the travel commands for raising and lowering the load 3.

In a step S3, the control facility 9 checks whether a safety stop has been triggered. If this is the case, the control facility 9 proceeds to a step S4, in which the control facility 9 ends the movement of the upper load suspension point 1, and with it the load 3, as quickly as possible (emergency stop). In a subsequent step S5, the control facility 9 then checks whether it is again given a release to resume the movement of the upper load suspension point 1. The control facility 9 carries out step S5 repeatedly until this takes place.

Figure 6:
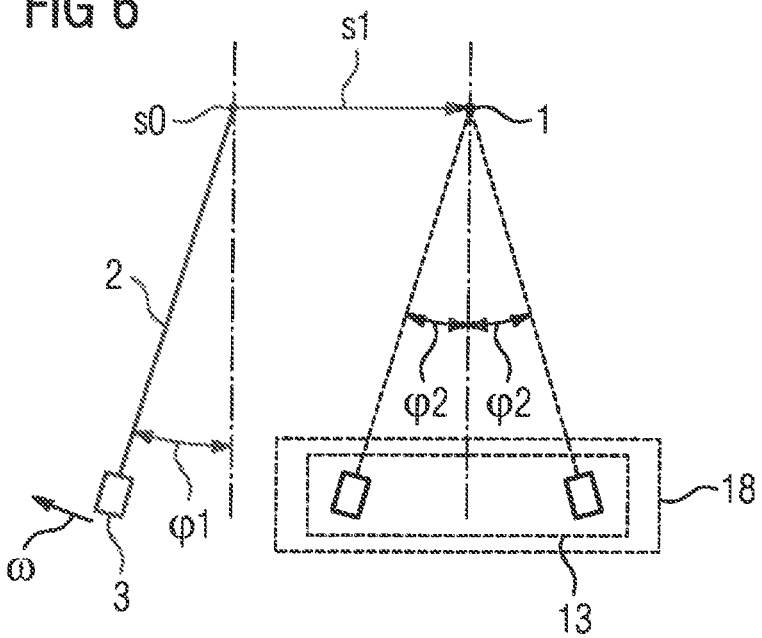

If a safety stop has not been triggered, the control facility 9 determines an inner safety zone 13 around the load 3 in a step S6 (see FIG. 6). The inner safety zone 13 is determined in such a way that, in the event of a suddenly occurring safety stop, the load 3 does not come into contact with objects 14 (see FIG. 1) if these are located outside the inner safety zone 13. The inner safety zone 13 extends horizontally over certain dimensions. This will be explained later. In the vertical direction, the inner safety zone 13, starting from the current position of the load 3 below the upper load suspension point 1, can in principle extend upward without limitation. Alternatively, it is possible that it extends upward only to a limited extent. The safety zone 13 is always limited in the downward direction, specifically—starting from the current height position of the load 3—by the braking distance which is required to stop the lifting mechanism 8 when lowering the load 3.

The inner safety zone 13 is determined as a function of state variables of the crane. These are the state variables as they exist at the time at which the safety stop is triggered. The state variables comprise at least the position of the upper load suspension point 1, that is to say, for example, its x and y position, the travel speed v of the upper load suspension point 1 and the distance of the load 3 from the upper load suspension point 1, that is to say as a result the effective pendulum length l. It is assumed hereinafter that the corresponding actual values x, y, l are involved. Alternatively, however, it may also be the set points x*, y*, l* that are involved. The determination of the inner safety zone 13 will be explained in more detail later.

In a step S7, the control facility 9 receives information from the surroundings of the load 3. The information can be made available to the control facility 3 in various ways—possibly also in combination. For example, it may be information about stationary obstacles, for example building structures. Such information need only be specified to the control facility 9 once. It can also be information about temporarily stationary obstacles, for example about other loads which have already been handled or have yet to be handled. Information about loads which have already been handled may be known to the control facility 9 on the basis of its operation in the past. Information about loads yet to be handled can be made known to the control facility 9 in some other way, for example by specifying a sequence to be processed for handling loads. It can also be information about movable obstacles, for example vehicles or persons. Such information can be made known to the control facility 9, for example via images from a camera or a plurality of cameras.

By evaluating the information received, the control facility 9 checks, in a step S8, whether an object 14 different from the load 3 is entering the inner safety zone 13.

If this is not the case, the control facility 9 proceeds to a step S9. In step S9, the control facility 9 executes the control commands C determined in step S2. It thus controls the drives 4*a*, 4*b*, 4*c* accordingly. The upper load suspension point 1, and with it the load 3, are thus operated by the control facility 9 in accordance with the desired actuation. As a result, the control facility 9 thus maintains the movement of the upper load suspension point 1. There is no special message M to the operator 12. In particular, in the case of manual operation, the control facility 9 controls the drives 4*a*, 4*b*, 4*c* in this case in accordance with the predefined travel commands F.

If, on the other hand, the control facility 9 has detected in step S8 that an object 14 different from the load 3 has entered the inner safety zone 13, the control facility 9 stops the movement of the upper load suspension point 1 in a step S10. Also in step S10, the movement of the upper load suspension point 1—analogously to step S4—is terminated as quickly as possible. Alternatively or in addition, in a step S11, the control facility 9 can output the aforementioned special message M to the operator 12. By means of the special message M, the operator 12 is prompted to stop the movement of the upper load suspension point 1.

Both from step S9 and from step S10 or from step S11 onwards, the control facility 9 returns to step S2. As a result, inter alia, the inner safety zone 13 is dynamically determined repeatedly during the movement of the upper load suspension point 1.

Various possibilities for determining the inner safety zone 13 in the horizontal direction are explained hereinafter. The determination in the vertical direction is simple and indiscriminate.

The determination of the inner safety zone 13 begins with the consideration that the upper load suspension point 1 is located at a current position s0 at the time at which the safety stop of step S10 is triggered, and is moving at a travel speed v. Assuming that the braking of the upper load suspension point 1 takes place with a constant acceleration a, the condition applies to the braking distance s1 of the upper load suspension point 1

$$s1=v^2/2a \tag{1}$$

The acceleration a is—of course—directed counter to the travel speed v.

It is also possible to carry out an analogous procedure for the pendulum length l. In this case, the change in the pendulum length l, that is to say, the lifting speed with which the load 3 is raised or lowered, is reduced to 0 via a speed ramp. The acceleration with which the lifting speed is reduced to 0 can alternatively be load-independent or load-dependent. In particular, when lowering the load 3, the acceleration with which the lifting speed is reduced to 0 can be dependent on the mass m of the load and if applicable, also on the position of the trolley 7 on the crossmember 6. If, on the other hand, the load 3 is being raised, the lifting speed can, as a rule, be reduced to 0 very quickly and independently of the mass of the load 3 and the position of the trolley 7 on the crossmember 6.

However, as a result of the current position s0 and the braking distance s1, the inner safety zone 13 is not yet fully defined. This is because the load 3 executes a pendulum movement at the time at which the safety stop is triggered. It is therefore necessary for the control facility 9 not only to take into account the current position s0 and the braking distance s1 of the upper load suspension point 1 when determining the inner safety zone 13, but rather the control facility 9 must in addition also take into account the pendulum movement of the load 3 around the upper load suspension point 1.

As aforementioned, the pendulum movement can be described by the effective pendulum length l, the current deflection angle φ1 and the current angular velocity ω. The pendulum length l is always known to the control facility 9. It is possible that the current deflection angle φ1 and the current angular velocity ω are also known to the control facility 9. However, it is also possible that they are not known to the control facility 9.

Figure 7:
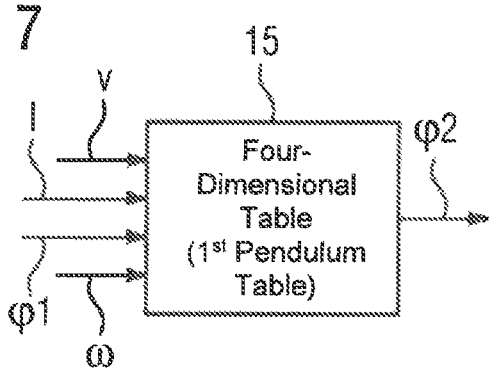

Hereinafter, there is initially no distinction between these two cases—the current deflection angle φ1 and the current angular velocity ω are known or not known to the control facility 9. Instead, it will be explained how a four-dimensional table 15 (see FIG. 7) can be filled with entries. Input variables for table 15 are—in each case related to the time at which the safety stop is triggered—the travel speed v, the effective pendulum length l, the current deflection angle φ1 and the current angular velocity ω. The output variable φ2 of table 15 for the pendulum movement of the load 3 at the time at which the upper load suspension point 1 is stopped is the maximum—not the current—deflection φ2 of the current pendulum movement, hereinafter referred to as the maximum deflection φ2. Table 15 is referred to as the first pendulum table 16 hereinafter.

In order to be able to determine the individual entries for the first pendulum table 15, the four input variables v, l, φ1 and ω must be varied incrementally. The other parameters—for example, acceleration a—are constant and predefined. For each specific combination of the four input variables v, l, φ1 and ω, the respective maximum deflection φ2 can be easily determined. In particular, the equations of motion of the upper load suspension point 1 and the load 3 are known and can be easily solved—analytically or numerically.

The limits for the input variables v, l, φ1 and ω of the first pendulum table 15 can easily be determined in a meaningful way. The maximum possible value for the travel speed v is readily known. The travel speed v has a minimum value of 0. The same applies to the pendulum length l. Here, too, a minimum value and a maximum value can easily be determined in a meaningful way. Reasonable assumptions may be made for the pendulum movement of the load 3 at the time at which the safety stop is triggered. In particular, based on empirical values, it can be known how strong the pendulum movement can be. For example, it can be empirically known that in actual operation there is a maximum oscillation of 5°. The empirical numerical value of 5° is, of course, only purely by way of example. Furthermore, the empirical numerical value may depend in particular on the pendulum length l and if applicable, also on the travel speed v.

In order to fill the first pendulum table 16, the various possible values for the travel speed v and the pendulum length l must therefore be processed incrementally (as a rule, as the outermost and innermost loop). Increments of these two loops can be determined as required. For each specific value of the travel speed v and the pendulum length l, the associated empirically maximum possible pendulum angle—hereinafter provided with the reference character α—is then determined in each case. Now possible values are set in an innermost loop—hereinafter provided with the reference character β—between 0 and the empirically maximum possible pendulum angle α and possible states are calculated in an innermost loop for the respective value β of the pendulum movement. The increments can also be determined as required for these two loops.

In order to explain the procedure somewhat more specifically, a program-like code is reproduced hereinafter. The variables v1, v2 and δv are used for the minimum value, the maximum value, and the increment of the travel speed v. In an analogous manner, the variables l1, l2 and δl are used for the minimum value, the maximum value, and the increment of the pendulum length l. The variable δβ is used for the increment when varying the maximum deflection β. The variable δφ is used for the increment when viewing the individual states of a specific pendulum movement.

```
Start do-loop v from v1 to v2 with δv
  Start do-loop I from I1 to I2 with δI
    (optional: define α)
    Start do-loop β from 0 to α with δβ
      Start do-loop φ1 from −β to +β with δφ
        define ω
          determine φ2
          invert ω
          re-determine φ2
      End do-loop φ1
    End do-loop β
  End do-loop I
End do-loop v
```

Figure 8:
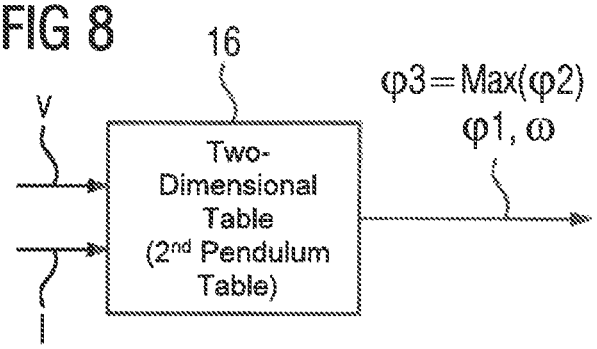

A further table 16 can be determined on the basis of the first pendulum table 15. The further table 16 is only two-dimensional as shown in FIG. 8. Hereinafter it is referred to as the second pendulum table 16. Input variables for the second pendulum table 16 are—in each case related to the time at which the safety stop is triggered—the travel speed v and the effective pendulum length l. Output variable φ3 of the second pendulum table 16 is the largest of the entries which is entered in the first pendulum table 15 for the respective travel speed v and the respective effective pendulum length as the maximum deflection φ2. The output variable φ3 of the second pendulum table 16 therefore indicates the maximum of the possible maximum deflections φ2 for a given travel speed v and a given effective pendulum length l.

In order to explain the procedure somewhat more specifically, a program-like code is reproduced hereinafter. The same nomenclature is used here as before for the first pendulum table 15. It is also assumed that the entries for the first pendulum table 15 have already been determined.

```
Start do-loop v from v1 to v2 with δv
  Start do-loop 1 from I1 to I2 with δI
    φ3 = Maximum of a φ2 ((φ1 and ω are varied)
  End do-loop I
End do-loop v
```

It is even possible, within the scope of the determination of the two pendulum tables 15, 16 explained above, to take into account the lifting speed and, if necessary, also the associated acceleration. As a result of this procedure, the two pendulum tables 15, 16 are, with regard to their input variables, possibly increased by one dimension (namely the lifting speed) or by two dimensions (namely the lifting speed and the acceleration with which the lifting speed is reduced to 0). The basic procedure remains the same, however.

Figure 9:
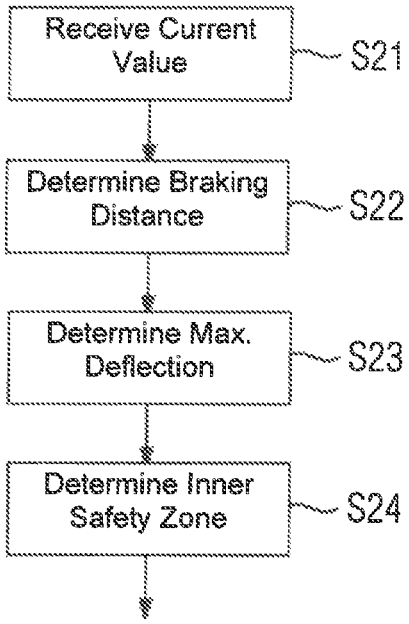

It is possible for the control facility 9 to receive the current values for the deflection angle φ1 and the angular velocity ω in a step S21, as shown in FIG. 9. In this case, the corresponding values φ1, ω are recorded by means of suitable measuring systems. The angular velocity ω can itself be determined by the control facility 9, if necessary, by determining the time derivatives of a plurality of deflection angles φ1 recorded one after the other. The measuring systems can be designed in particular as secure measuring systems.

Likewise, the control facility 9 can also receive other values which characterize the pendulum movement. In this case, the control facility 9 can determine the deflection angle φ1 and the angular velocity ω based on the characteristic variables.

Thus, the state variables on the basis of which the control facility 9 determines the inner safety zone 13, that is to say in addition to the travel speed v and to the effective pendulum length l for the actual pendulum movement, comprise characteristic variables φ1, ω. The control facility 9 is therefore not only able to determine the braking distance s1 in a step S22, but rather, in a step S23, the control facility 9 is also able to determine the maximum deflection φ2 on the basis of the four values v, l, φ1 and ω which are now specifically given. In this case, it is possible for the control facility 9 to perform an analytical determination. However, the determination has preferably already been undertaken and is made available to the control facility 9 as shown in FIG. 4 in the form of the first pendulum table 15. The maximum deflection φ2 can be an angle. In this case, the pendulum length l must also be taken into account in order to determine the associated longitudinal deflection s2;

$$s2=l\cdot\sin(\varphi 2) \tag{2}$$

In a step S24, the control facility 9 then determines the inner safety zone 13. The inner safety zone 13 is thus obtained from the procedure by taking into account the braking distance s1 and the longitudinal deflection s2. In the simplest case, viewed in the current direction of travel, the position s is obtained as the boundary of the inner safety zone 13 as follows:

$$s=s0+s1+s2 \tag{3}$$

In addition, the control facility 9 can also use other variables when determining the inner safety zone 13. In contrast to the aforementioned variables, however, these variables do not change when moving the upper load suspension point 1. Examples of such variables are the dimensions of the load 3 or maximum possible dimensions of the load 3. For example, if the load 3 is a container, it may be known that 48-foot containers maximum are handled. The associated length, width and height would correspond to maximum values for the dimensions of the load 3. Specifically, for example if a 40-foot container or a 20-foot container is handled, however, these values can also be used as an alternative.

Figure 10:
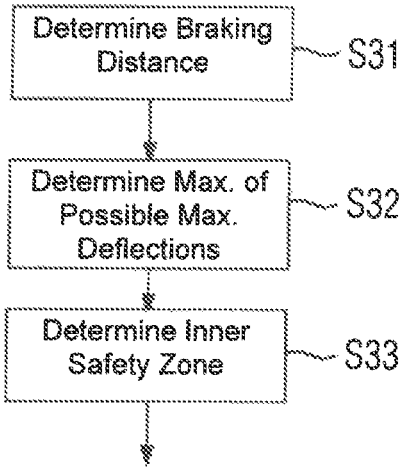

Alternatively, it is possible that the control facility 9 does not receive the current values for the deflection angle φ1 and the angular velocity ω (or other values which characterize the actual pendulum movement), In this case, the control facility 9 can only undertake a worst-case assessment. A step S31 (FIG. 10) can correspond 1:1 to step S22. However, as shown in FIG. 10, the control facility 9 can only determine the maximum φ3 of the possible maximum deflections φ2 in a step S32. Theoretically, here too it is again possible for the control facility 9 to perform an analytical determination. Here too, however, the determination has preferably already been undertaken beforehand and is made available to the control facility 9 in the form of the second pendulum table 16, as shown in FIG. 4. Analogously to the maximum deflection φ2, the maximum φ3 can be an angle. In this case, the pendulum length l must also be taken into account in order to determine the associated longitudinal deflection s2:

$$s2=l\cdot\sin(\varphi 3) \quad (4)$$

In a step S33, the control facility 9 then determines the inner safety zone 13. The step S33 corresponds to the step S24 in FIG. 8.

Figure 11:
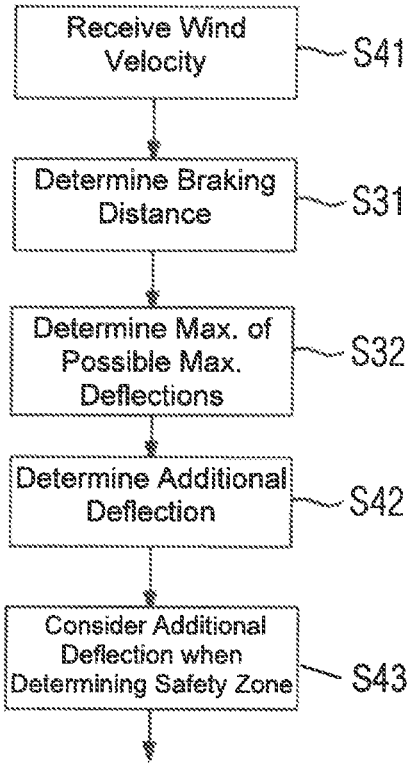

The procedure of FIG. 10 may be further configured. In particular, as shown in FIGS. 4 and 11, it is possible that the control facility 9 does not receive the deflection angle φ1 and the angular velocity ω in a step S41, but nevertheless receives a wind velocity vW of a wind flowing around the load 3. The wind velocity vW can be predefined as a pure amount. However, it can also be predefined as a vector variable.

Figure 12:
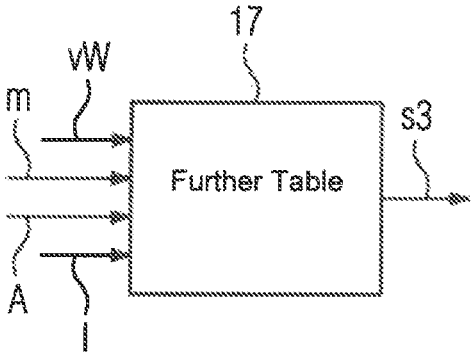

On the basis of the receipt of the wind velocity vW, the state variables on the basis of which the inner safety zone 13 is determined can thus additionally comprise the wind velocity vW. As a result, the control facility 9 is able to determine an additional deflection s3 in a step S42. The additional deflection s3 corresponds to the static deflection of the load 3 caused by the wind velocity vW. It is dependent on the effective pendulum length l, the force exerted by the wind on the load 3 and the mass m of the load 3. The force is in turn dependent on the wind velocity vW. It is therefore possible, for example, to determine a further table 17 as shown in FIG. 12. The table 17 can have the wind velocity vW, the mass m of the load 3, an effective contact surface A of the load 3 for the wind and the effective pendulum length l as input variables and provide the additional deflection s3 as an output variable. Here too, however, an analytical determination is again possible.

However, regardless of the manner in which the control facility 9 determines the additional deflection s3, the control facility 9 is able, in a step S43, to take into account not only the braking distance s1 and the longitudinal deflection s2, but additionally also the additional deflection s3 within the scope of the determination of the inner safety zone 13.

The present invention may also be configured in other ways. This will be explained in more detail hereinafter in connection with FIG. 13.

Figure 13:
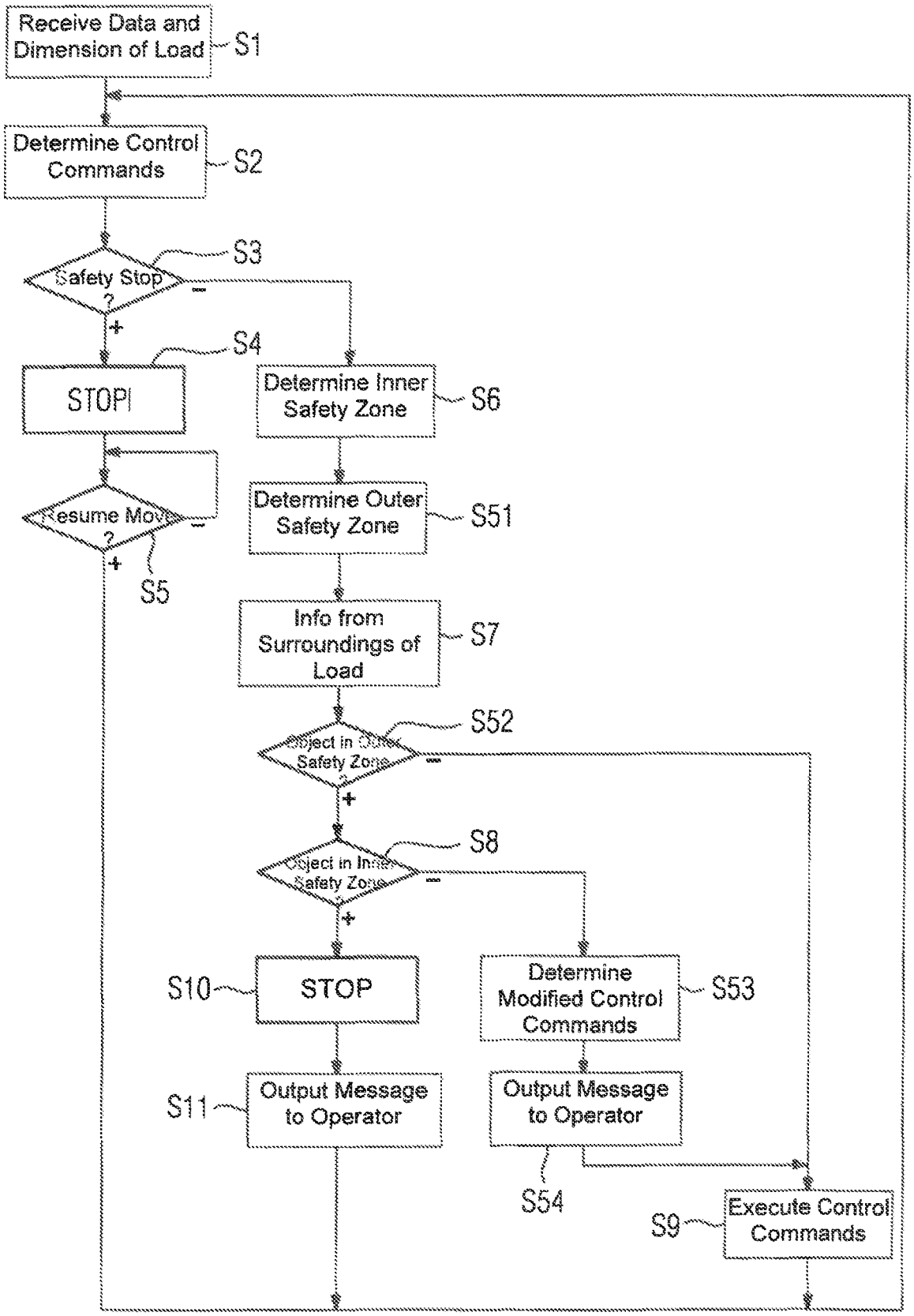

FIG. 13 is based on the procedure of FIG. 5. However, steps S51 through S54 are also present.

In step S51, the control facility 9 determines at least one outer safety zone 18. The outer safety zone 18 surrounds the inner safety zone 13, as shown in FIG. 6. The step S51 is dynamically repeated by the control facility 9—just as in step S6. The outer safety zone 18 is also determined as a function of the same state variables as the inner safety zone 13.

In step S52, the control facility 9 checks whether the object 14 is entering the outer safety zone 18. If this is not the case, the control facility 9 proceeds to step S9. In particular in manual operation, the control facility 9 performs the actuation of the drives 4*a*, 4*b*, 4*c* in this case in accordance with the predefined travel commands F. Any message M' for reducing the travel speed v is not output to the operator 12. If, on the other hand, this is the case, the control facility 9 proceeds to step S8.

If the control facility 9 determines in step S8 that the object 14 has entered the outer safety zone 18 but not the inner safety zone 13, the control facility 9 proceeds to a step S53. In step S53, the control facility 9 determines modified control commands C. In particular, in step S53 the control facility 9 reduces the travel speed v of the upper load suspension point 1. Alternatively or in addition, it can output a corresponding message M' to the operator 12 to reduce the travel speed v, step S54.

In summary, the present invention thus relates to the following facts:

A crane has an upper load suspension point 1 from which a load 3 is suspended via a cable system 2 so that the load 3 can swing around the upper load suspension point 1. A control facility 9 of the crane controls drives 4*a*, 4*b* of the crane so that the upper load suspension point 1, and with it the load 3, are moved by the control facility 9 in accordance with the actuation. The control facility 9 dynamically determines an inner safety zone 13 around the load 3 repeatedly when moving the upper load suspension point 1 as a function of state variables x, v, l, φ1, ω, vW of the crane. The state variables x, v, l, φ1, ω, vW comprise at least one position x of the upper load suspension point 1, one travel speed v of the upper load suspension point 1 and one effective pendulum length l of the load 3 around the upper load suspension point 1. The control facility 9 checks, on the basis of further information known from the control facility 9, whether an object 14 different from the load 3 is entering the inner safety zone 13. As soon as an object 14 enters the inner safety zone 13, the control facility 9 stops the movement of the upper load suspension point 1 or outputs a message M to an operator 12 of the crane to stop the movement of the upper load suspension point 1. Otherwise, the control facility 9 maintains the movement of the upper load suspension point 1 or does not output a message M to the operator 12 of the crane to stop the movement of the upper load suspension point 1.

The present invention has many advantages. In particular, it can be ensured in a simple and efficient manner that the load 3, although it can swing, does not collide with an object (object 14) which suddenly appears, even in the event of a sudden safety stop. This applies equally to manual operation and to automated operation of the crane. Otherwise, this risk exists, although in normal operation a so-called sway control acts. This is because, with the triggering of a safety stop, such a sway control loses its function as the safety stop has priority. Furthermore, the present invention can also be used in cranes in which the effective pendulum length l may reach high values—in some cases over 50 m. In the case of such great pendulum lengths l, inclined stranding, which effectively prevents appreciable swinging of the load 3 in short pendulum lengths l, is virtually ineffective. Furthermore, on the one hand, a simple implementation is possible in which only variables which are readily available during operation of the crane are used, namely the pendulum length l and the travel speed v. This solution is very cost-effective. Alternatively, it is possible to also record the current pendulum movement. As a result, the inner and, if appropriate, also the outer safety zone 13, 18 can be defined to be as small and safe as possible according to the situation.

Although the invention has been illustrated and described in detail by the preferred exemplary embodiment, the invention is not limited by the disclosed examples, and other variations may be derived therefrom by a person skilled in the art without departing from the scope of the invention.

The invention claimed is:

1. A method for operating a crane with a control facility of the crane, the method comprising:

suspending a load from an upper load suspension point via a cable system so as to enable the load to swing around the upper load suspension point, controlling drives of the crane configured to move the upper load suspension point and the load, when moving the upper load suspension point, dynamically determining an inner safety zone around the load repeatedly as a function of state variables of the crane, with the state variables comprising at least a position of the upper load suspension point, a travel speed of the upper load suspension point and an effective pendulum length of the load around the upper load suspension point, checking, based on further information known to the control facility, whether an object different from the load is entering the inner safety zone, and when the object different from the load enters the inner safety zone, stopping moving the upper load suspension point or outputting to an operator of the crane a message to stop moving of the upper load suspension point, and otherwise continuing moving the upper load suspension point or not outputting to the operator of the crane the message to stop moving of the upper load suspension point.

2. The method of claim 1, further comprising:

dynamically determining an outer safety zone surrounding the inner safety zone as a function of the state variables, checking, based on the further information, whether an object different from the load is entering the outer safety zone, and when an object different from the load enters the outer safety zone, reducing the travel speed of the upper load suspension point or outputting a message to the operator of the crane to reduce the travel speed of the upper load suspension point, and otherwise maintaining the travel speed of the upper load suspension point or not outputting to the operator of the crane the message to reduce the travel speed of the upper load suspension point.

3. The method of claim 2, further comprising:

operating the control facility in manual operation, wherein the control facility repeatedly receives from the operator travel commands for the upper load suspension point, and controlling the drives when no object different from the load has entered the outer safety zone commensurate with the travel commands received from the operator.

4. The method of claim 1, further comprising:

operating the control facility in manual operation where the control facility repeatedly receives from the operator travel commands for the upper load suspension point and controlling the drives when no object different from the load has entered the inner safety zone commensurate with the travel commands received from the operator.

5. The method of claim 1, further comprising:

determining a braking distance of the upper load suspension point based on a current travel speed of the upper load suspension point, and taking into account the braking distance and a pendulum movement of the load around the upper load suspension point when determining the inner safety zone.

6. The method of claim 5, further comprising determining the braking distance based on a previously known, constant acceleration.

7. The method of claim 5, wherein the state variables comprise additional variables characteristic of an actual pendulum movement, the method further comprising:

determining a maximum deflection of the pendulum movement based on the additional variables, and taking into account the determined maximum deflection when determining the inner safety zone.

8. The method of claim 5, further comprising:

taking the pendulum movement into account by obtaining from a pendulum table a travel-speed value dependent on the travel speed of the upper road suspension point and the effective pendulum length, and determining the inner safety zone from the travel-speed value.

9. The method of claim 8, wherein the state variables additionally comprise a wind velocity of a wind flowing around the load, the method further comprising:

taking into account a deflection of the load caused by the wind when determining the inner safety zone.

10. The method of claim 9, further comprising:

determining the deflection of the load caused by the wind by using from a wind table a value which is dependent on the wind velocity, a mass of the load and an attack surface of the load exposed to the wind, and determining the deflection of the load caused by the wind based on the basis of the value from the wind table.

11. A computer program product for a control facility controlling a crane, which carries a load suspended from an upper load suspension point via a cable system so as to enable the load to swing around the upper load suspension point, the computer program product embodied in a non-transitory computer-readable medium and comprising machine code which, when loaded into a memory of a processor of the control facility and executed by the processor, causes the control facility to operate the crane by:

controlling drives of the crane configured to move the upper load suspension point and the load, when moving the upper load suspension point, dynamically determining an inner safety zone around the load repeatedly as a function of state variables of the crane, with the state variables comprising at least a position of the upper load suspension point, a travel speed of the upper load suspension point and an effective pendulum length of the load around the upper load suspension point, checking, based on further information known to the control facility, whether an object different from the load is entering the inner safety zone, and when an object different from the load enters the inner safety zone, stopping moving the upper load suspension point or outputting to an operator of the crane a message to stop moving of the upper load suspension point, and otherwise continuing moving the upper load suspension point or not outputting to the operator of the crane the message to stop moving of the upper load suspension point.

12. A control facility for controlling a crane with the computer program product as claimed in claim 11.

13. A crane, comprising:

a cable system having an upper load suspension point from which a load is suspended so as to enable the load to swing around the upper load suspension point, at least one drive configured to move the upper load suspension point and the load, and a control facility configured to control the at least one drive so as to move the upper load suspension point and the load commensurate with control commands from the control facility, when moving the upper load suspension point, dynamically determine an inner safety zone around the load repeatedly as a function of state variables of the crane, with the state variables comprising at least a position of the upper load suspension point, a travel speed of the upper load suspension point and an effective pendulum length of the load around the upper load suspension point, check, based on further information known to the control facility, whether an object different from the load is entering the inner safety zone, and when an object different from the load enters the inner safety zone, stop moving the upper load suspension point or output to an operator of the crane a message to stop moving of the upper load suspension point, and otherwise continue moving the upper load suspension point or not output to the operator of the crane the message to stop moving of the upper load suspension point.

* * * * *